US008393559B2

(12) United States Patent
Chen

(10) Patent No.: US 8,393,559 B2
(45) **Date of Patent: *Mar. 12, 2013**

(54) PAPER INLET SAFETY PROTECTION DEVICE FOR SHREDDERS

(75) Inventor: Xinxiong Chen, Shanghai (CN)

(73) Assignee: Aurora Office Equipment Co., Ltd Shanghai (CN)

( * ) Notice: Subject to any disclaimer, the term of this patent is extended or adjusted under 35 U.S.C. 154(b) by 363 days.

This patent is subject to a terminal disclaimer.

(21) Appl. No.: 12/842,366

(22) Filed: Jul. 23, 2010

(65) Prior Publication Data

US 2011/0000989 A1 Jan. 6, 2011

(30) Foreign Application Priority Data

Jul. 31, 2009 (CN) ..... 2009 1 0055706

(51) Int. Cl.
*B02C 23/00* (2006.01)

(52) U.S. Cl. ..... 241/37.5; 241/100

(58) Field of Classification Search ..... 241/37.5, 241/100, 236

See application file for complete search history.

(56) References Cited

U.S. PATENT DOCUMENTS

| | | | | |
|---|---|---|---|---|
| 6,065,696 | A * | 5/2000 | Tsai | 241/37.5 |
| 7,757,985 | B2 * | 7/2010 | Chen | 241/37.5 |
| 7,988,079 | B2 * | 8/2011 | Chen et al. | 241/36 |
| 8,079,537 | B2 * | 12/2011 | Chen | 241/37.5 |
| 8,091,809 | B2 * | 1/2012 | Hu et al. | 241/30 |
| 2008/0128537 | A1 * | 6/2008 | Huang | 241/37.5 |
| 2011/0024535 | A1 * | 2/2011 | Chen | 241/37.5 |

* cited by examiner

*Primary Examiner* — Faye Francis
(74) *Attorney, Agent, or Firm* — WHGC, PLC; John F. O'Rourke; Erick P. Wolf

(57) ABSTRACT

A paper inlet safety protection device with an upper cover plate, a safety cover plate, a paper entrance block and an elastic component. The upper cover plate is connected with the upper cover plate, first end of the upper cover plate covers inlet of the paper entrance of the upper cove plate, paper entrance block is arranged toward the paper entrance and in the upper cover plate, and limits the second end of the safety cover plate, two ends of the elastic component connect with the inner wall of the upper cover plate and the paper entrance block respectively, the paper entrance block is connected fixedly with the second end, or integrated with the second end, or limits the studs arranged on the second end, the paper entrance block is positioned between the paper entrance and the elastic component, the safety cover plate is pivoted with the upper cover plate.

8 Claims, 3 Drawing Sheets

PAPER INLET SAFETY PROTECTION DEVICE FOR SHREDDERS

CROSS-REFERENCE TO RELATED APPLICATION

This application claims priority of Chinese Patent Application No. 200910055706.7 filed Jul. 31, 2009.

TECHNOLOGY FIELD

The present invention relates to the field of shredders, especially to the field of protection devices for shredders, in particular to a paper inlet safety protection device for shredders.

BACKGROUND TECHNOLOGY

The applications of the safety protection devices of commercially available shredders, especially the safety protection devices of paper entrances, at present all are to push an ejector block in the paper entrance by feeding a lot of paper to move the block backward or downward to press a switch to result in the power failure of the switch detecting the paper entrance to stop the shredding motion of the machine so as to protect users.

Another patent Shredder Safety Cover Plate (Patent title: New-type shredder safety paper inlet structure, Patent number: ZL200720126922.2) of the present applicant is to force the structure on the safety cover plate by combining the function that the open and close of the safety cover plate can close the paper entrance with a lot of fed paper to touch a power switch to result in the power failure of the machine.

Because the ejector block in the paper entrance is moved backward or downward, it indicates that at that time the paper entrance is broader, if at that time the paper entrance is closed, the possibility of the entry of foreign matters can be eliminated, therefore safer protection can be provided for the use of users.

In order to solve the above existing problems, it is very necessary to further improve the paper inlet safety devices for shredders, so as to provide a paper inlet safety device for shredders with a low cost and a better effect of safety.

DISCLOSURE OF THE INVENTION

Aspects of the present invention generally pertain to a paper inlet safety protection device for shredders, which is designed dexterously, has a simple structure, is safe and reliable, has a low cost, is practical in function, simple and convenient to use, and achieves a further improvement to the safety function of shredders, then is suitable for popularization and application on a large-scale.

In order to realize the above aims, the paper inlet safety protection device for shredders of the present invention has the following structures:

In an aspect, the paper inlet safety protection device for shredders comprises an upper cover plate and a safety cover plate, the upper cover plate has a paper entrance, the safety cover plate comprises a first end and a second end, and is connected rotatably with the upper cover plate, the first end covers the inlet of the paper entrance, the paper inlet safety protection device for shredders further comprises a paper entrance block and an elastic component, the paper entrance block is arranged slideably toward the paper entrance and in the upper cover plate, and limits/is connected with the second end, two ends of the elastic component are connected with the inner wall of the upper cover plate and the paper entrance block respectively.

In a further aspect, the paper entrance block is connected fixedly with the second end.

In a further aspect, the paper entrance block and the second end are integrated as a whole.

In a further aspect, the paper entrance block is positioned between the paper entrance and the elastic component.

In yet another aspect, the elastic component is a tension spring.

In a further aspect, the second end has at least one stud, and the paper entrance block limits the stud.

In a further aspect, the safety cover plate is pivoted with the upper cover plate.

In yet another aspect, two rotating shafts are arranged at two sides of the safety cover plate, two opposite shaft seats are arranged in the upper cover plate, the safety cover plate is positioned between the two shaft seats, and the two rotating shafts are located in the two shaft seats respectively.

The beneficial effects of the present invention are that: when paper is shredded normally, the safety cover plate is opened an appropriate clearance, when too much paper or foreign matters enter into the paper entrance, the safety cover plate is pushed open to cause the paper entrance block to enter into the paper entrance, so as to close the paper entrance, to provide safety protection for users when they are feeding paper, and when the paper fed is reduced to be within a permitted range or the foreign matters are removed, the tension spring would cause the paper entrance block to exit the paper entrance to achieve reposition, therefore the paper inlet safety protection device for shredders is designed dexterously, has a simple structure, is safe and reliable, has a low cost, is practical in function, simple and convenient to use, and achieves a further improvement to the safety function of shredders, then is suitable for popularization and application on a large-scale.

PREFERRED EMBODIMENTS OF THE INVENTION

Figure 1:
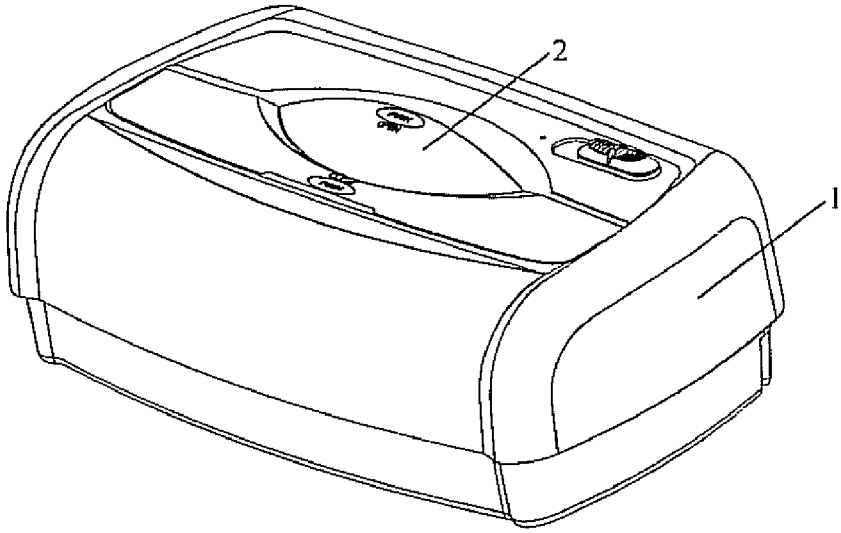
FIG. 1 is a stereogram of one embodiment of the present invention.
Figure 2:
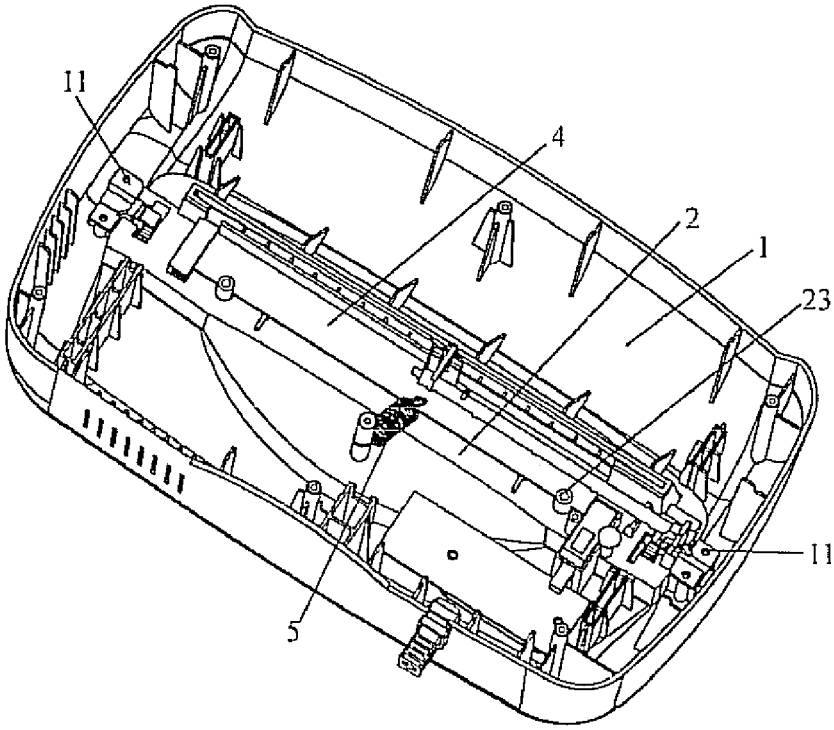
FIG. 2 is another stereogram of the embodiment shown in FIG. 1.

In order to understand the technical content of the present invention more clearly, the present invention would be exemplified further by reference to the following embodiments.

Please refer to FIG. 1~4, the paper inlet safety protection device for shredders of the present invention comprises an upper cover plate 1 and a safety cover plate 2, the upper cover plate 1 has a paper entrance 3, the safety cover plate 2 comprises a first end 21 and a second end 22, and is connected rotatably with the upper cover plate 1, the first end 21 covers the inlet of the paper entrance 3, the paper inlet safety protection device for shredders further comprises a paper entrance block 4 and an elastic component 5, the paper entrance block 4 is arranged slideably toward the paper entrance 3 and in the upper cover plate 1, and limits the second end 22, two ends of the elastic component 5 are connected with the inner wall of the upper cover plate 1 and the paper entrance block 3 respectively.

In a further aspect, the paper entrance block 4 is positioned between the paper entrance 3 and the elastic component 5. The paper entrance block 4 enters into the paper entrance 3 through pulling the elastic component 5, and exits the paper entrance 3 by the pulling force of the elastic component 5 to achieve reposition. In the present embodiment of the present invention, the elastic component 5 is a tension spring. The paper entrance block 4 also can be located beside the paper entrance 3 and the elastic component 5, that is, the paper entrance 3 and the elastic component 5 are located at the same side of the paper entrance block 4, then the paper entrance block 4 enters into the paper entrance 3 through pressing the elastic component 5, and exits the paper entrance 3 by the elasticity of the elastic component 5 to achieve reposition.

In a further aspect, the second end 22 has at least one stud 23, and the paper entrance block 4 limits the stud 23. In the present embodiment of the present invention, the second end 22 has two studs 23.

In a further aspect, the safety cover plate 2 is pivoted with the upper cover plate 1. In the present embodiment of the present invention, two rotating shafts are arranged at two sides of the safety cover plate 2, two opposite shaft seats 11 are arranged in the upper cover plate 1, the safety cover plate 2 is positioned between the two shaft seats 11, and the two rotating shafts are located in the two shaft seats 11 respectively.

Figure 3:
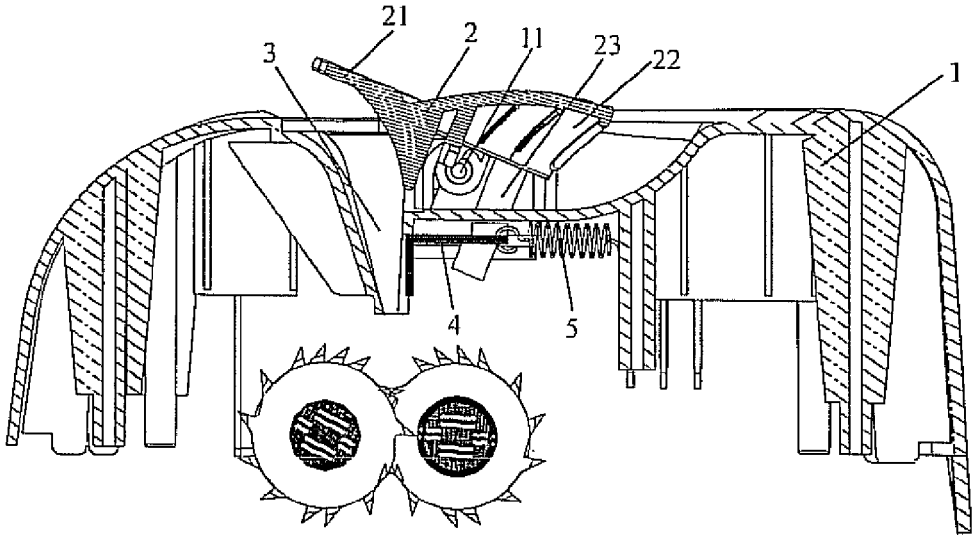
FIG. 3 is a partial cutaway schematic view of a shredder with the embodiment shown in FIG. 1 when paper is shredded normally.
Figure 4:
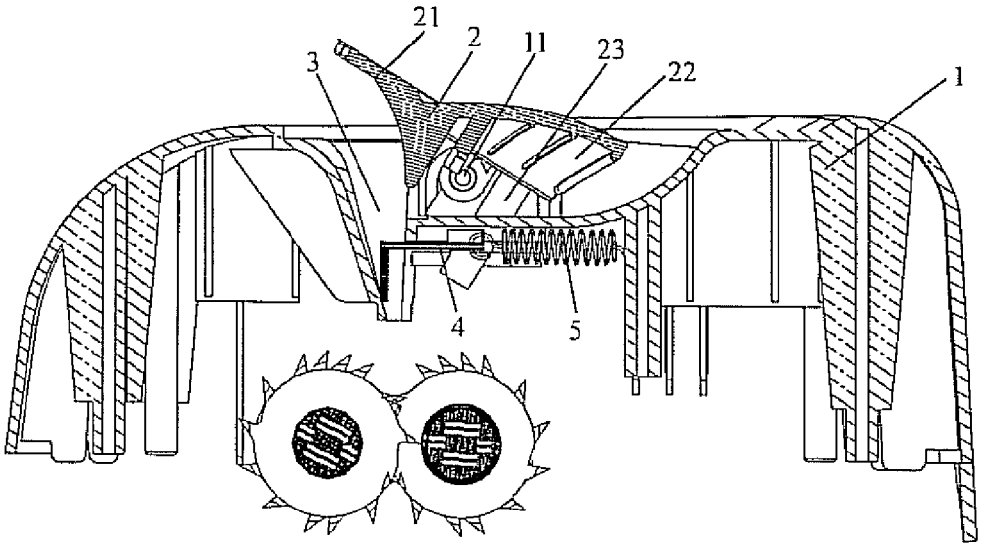
FIG. 4 is a partial cutaway schematic view of the shredder shown in FIG. 3 when too much paper or foreign matters enter into the paper entrance.

When shredding paper is not started, the safety cover plate 2 covers the inlet of the paper entrance 3, and the paper entrance 3 is in a fully closed state, when the shredder works, the safety cover plate 2 is rotated a certain angle to form a clearance for feeding paper with the upper cover plate 1, therefore the paper entrance 3 is opened, and paper can be fed into the shredder through the paper entrance 3, as shown in FIG. 3, at this time, the studs 23 of the second end 22 of the safety cover plate 2 do not touch the paper entrance block 4, or through the studs 23 touch the paper entrance block 4, due to the relatively small angle the safety cover plate 2 rotated and the tension of the tension spring, it is not enough to cause the paper entrance block 4 to enter into the paper entrance 3 to affect paper feeding, so paper is shredded normally; when too much paper or foreign matters enter into the paper entrance 3, the safety cover plate 2 is pushed by too much paper or foreign matters to rotate continuously to enlarge the clearance of the paper entrance 3, the studs 23 of the second end 22 of the safety cover plate 2 push the paper entrance block 4 to overcome the pulling force of the tension spring to move forward to close the paper entrance 3 completely, as shown in FIG. 4, to prevent the entry of two much paper or foreign matters, so as to achieve the aim of providing users with safer and more reliable application.

Figure 5:
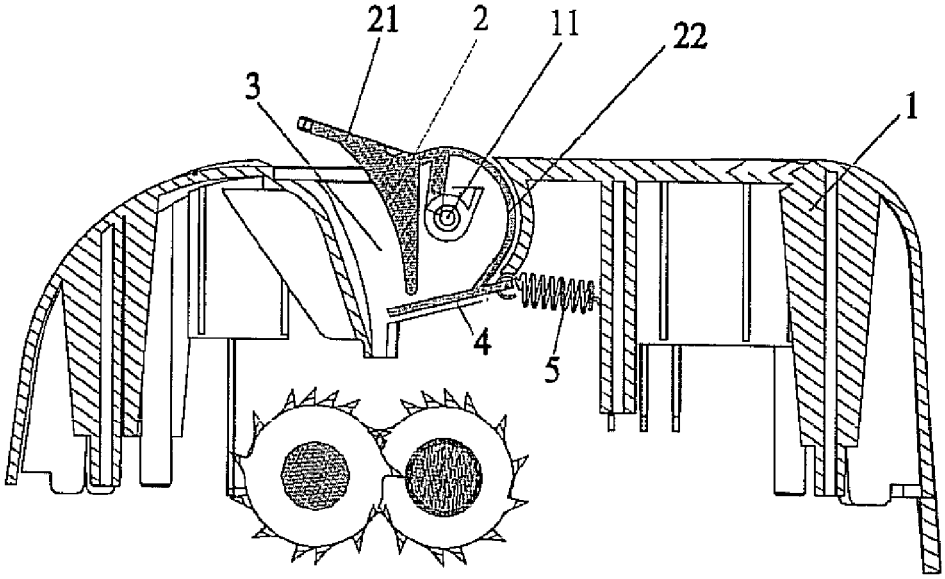
FIG. 5 is a partial cutaway schematic view of a shredder with another embodiment of the present invention when paper is shredded normally.
Figure 6:
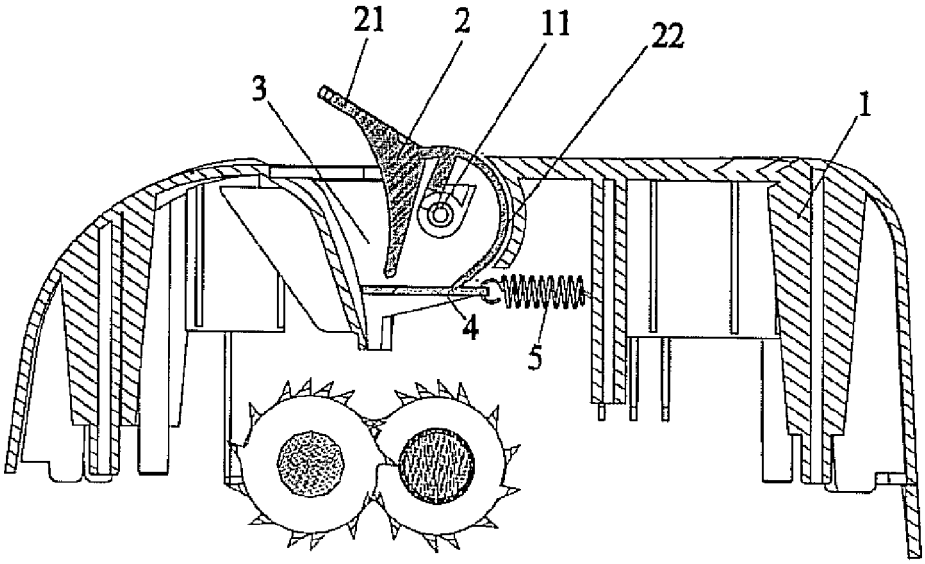
FIG. 6 is a partial cutaway schematic view of the shredder shown in FIG. 5 when too much paper or foreign matters enter into the paper entrance.

Please refer to FIG. 5~6, and FIGS. 5 and 6 show a partial cutaway schematic view of a shredder with another embodiment of the present invention, wherein the same component uses the same reference sign, and the differences of this embodiment from the above-mentioned embodiment are that the paper entrance block 4 does not limit the second end 22, but is connected with the second end 22.

In a further aspect, the paper entrance block 4 is connected fixedly with the second end 22. Of course, they can be connected movably with each other, as long as when the safety cover plate 2 rotates too much, the paper entrance block 4 would be driven by the safety cove plate 2 to overcome the pulling force of the tension spring to move forward to completely close the paper entrance 3. In the present embodiment of the present invention, the paper entrance block 4 and the second end 22 are integrated as a whole.

When shredding paper is not started, the safety cover plate 2 covers the inlet of the paper entrance 3, and the paper entrance 3 is in a fully closed state, when the shredder works, the safety cover plate 2 is rotated a certain angle to form a clearance for feeding paper with the upper cover plate 1, therefore the paper entrance 3 is opened, and paper can be fed into the shredder through the paper entrance 3, as shown in FIG. 5, at this time, due to the relatively small angle the safety cover plate 2 rotated and the tension of the tension spring, it is not enough to cause the paper entrance block 4 integrated with the second end 22 of the safety cover plate 2 as a whole to enter into the paper entrance 3 to affect paper feeding, so paper is shredded normally; when too much paper or foreign matters enter into the paper entrance 3, the safety cover plate 2 is pushed by too much paper or foreign matters to rotate continuously to enlarge the clearance of the paper entrance 3, the paper entrance block 4 integrated with the second end 22 of the safety cover plate 2 would overcome the pulling force of the tension spring to move forward to close the paper entrance 3 completely, as shown in FIG. 6, to prevent the entry of two much paper or foreign matters, so as to achieve the aim of providing users with safer and more reliable application.

To sum up, the paper inlet safety protection device for shredders of the invention is designed dexterously, has a simple structure, is safe and reliable, has a low cost, is practical in function, simple and convenient to use, and achieves a further improvement to the safety function of shredders, then is suitable for popularization and application on a large-scale.

While the present invention has been particularly shown and described with references to preferred embodiments thereof, it will be understood by those skilled in the art that various changes in form and details may be made therein without departing from the spirit and scope of the invention as defined by the claims. It is clearly understood therefore that the same is by way of illustration and example only and is not to be taken by way of limitation.

The invention claimed is:

1. A paper inlet safety protection device for shredders, comprising an upper cover plate and a safety cover plate, the upper cover plate having a paper entrance, the safety cover plate comprising a first end and a second end, and being connected rotatably with the upper cover plate, the first end covering the inlet of the paper entrance, wherein the paper inlet safety protection device for shredders further comprises a paper entrance block and an elastic component, the paper entrance block is arranged slideably toward the paper entrance and in the upper cover plate, and limits/is connected with the second end, two ends of the elastic component are connected with the inner wall of the upper cover plate and the paper entrance block respectively.

2. The paper inlet safety protection device for shredders according to claim 1, wherein the paper entrance block is connected fixedly with the second end.

3. The paper inlet safety protection device for shredders according to claim 1, wherein the paper entrance block and the second end are integrated as a whole.

4. The paper inlet safety protection device for shredders according to claim 1, wherein the paper entrance block is positioned between the paper entrance and the elastic component.

5. The paper inlet safety protection device for shredders according to claim 4, wherein the elastic component is a tension spring.

6. The paper inlet safety protection device for shredders according to claim 1, wherein the second end has at least one stud, and the paper entrance block limits the stud.

7. The paper inlet safety protection device for shredders according to claim 1, wherein the safety cover plate is pivoted with the upper cover plate.

8. The paper inlet safety protection device for shredders according to claim 7, wherein two rotating shafts are arranged at two sides of the safety cover plate, two opposite shaft seats are arranged in the upper cover plate, the safety cover plate is positioned between the two shaft seats, and the two rotating shafts are located in the two shaft seats respectively.

* * * * *